US005467260A

United States Patent [19]

Aspenwall

[11] Patent Number: 5,467,260

[45] Date of Patent: Nov. 14, 1995

[54] LENS RETAINER SYSTEM FOR A SHOWCASE LIGHT

[75] Inventor: John E. Aspenwall, Lehi, Utah

[73] Assignee: Jahabow Industries, Inc., Owensville, Mo.

[21] Appl. No.: 407,116

[22] Filed: Mar. 20, 1995

[51] Int. Cl.[6] ..... F21V 21/00

[52] U.S. Cl. ..... 362/374; 362/455

[58] Field of Search ..... 362/125, 223, 362/374, 375, 455

[56] References Cited

U.S. PATENT DOCUMENTS

| | | | |
|---|---|---|---|
| D. 192,124 | 1/1962 | Michaud | D48/23 |
| D. 280,346 | 8/1985 | Aspenwall | D26/75 |
| D. 344,605 | 2/1994 | Aspenwall | D26/76 |
| 723,943 | 3/1903 | Taussig et al. | 362/287 |
| 845,652 | 2/1907 | La Berge | 362/126 |
| 1,466,944 | 9/1923 | Baughn | 362/374 |
| 2,336,587 | 12/1943 | Bixby | 339/54 |
| 3,064,124 | 11/1962 | Husby et al. | 362/221 |
| 4,535,393 | 8/1985 | Aspenwall | 362/217 |
| 4,598,341 | 7/1986 | Brackhahn et al. | 362/125 |
| 4,739,454 | 4/1988 | Federgreen | 362/133 |
| 4,868,727 | 9/1989 | Ponds et al. | 362/374 X |
| 4,994,943 | 2/1991 | Aspenwall | 362/219 |
| 5,040,101 | 8/1991 | Aspenwall | 362/125 |
| 5,245,518 | 9/1993 | Aspenwall | 362/226 |

*Primary Examiner*—Stephen F. Husar
*Attorney, Agent, or Firm*—M. Reid Russell

[57] ABSTRACT

A showcase light lens retainer system consisting of a pair of identical retainers each for pivotal mounting to a showcase or display light housing, adjacent to an opening into said housing that is covered by a thin flat transparent or translucent lens. The individual retainers each include a side portion for pivoting over a lens end that is stepped upwardly at a side wall, above a pivotal connection of the receptacle to the housing, a distance that is approximately the same or slightly greater that the lens thickness and includes a tab that projects outwardly from the top edge of the side portion that is stepped downwardly at right angle a tab wall from the side portion to provide a wall for engaging a top or bottom lens edge, the respective stepped side portion wall to engage the lens end and the tab wall to engage the lens top or bottom edge, adjacent to the lens end, each retainer maintaining a lens end in covering arrangement over the housing opening.

4 Claims, 2 Drawing Sheets

LENS RETAINER SYSTEM FOR A SHOWCASE LIGHT

BACKGROUND OF THE INVENTION

1. Field of the Invention

This invention relates to lighting systems for merchandise showcases and displays where the light is mounted unobtrusively within a showcase and where access to change the bulb must be provided through an area covered by a lens.

2. Prior Art

Retail store display cases or showcases that incorporate glass front, side and even back walls to prominently display products contained therein are common in retail settings. Such showcases are often free standing, but can be elevated and supported on a wall surface, can be maintained on braces or supports arranged between piers, or the like, and such have long been known and are in common use. Such showcases generally include one or more lights mounted unobtrusively therein to illuminate and attractively display items contained in such display case. Which lights, of course, have electric bulbs that need to be readily accessible for changing when burned out. The present invention addresses this need by providing a readily accessible lens mount arrangement that is easily operated to allow for release of the lens to allow for removal of a burned out bulb.

Display lights having removable lenses are not new and U.S. Pat. Nos. 5,040,101 and 5,245,518 and a Des. 344,605, of the present inventor show examples of lights with removable lens for covering over a bulb containing area of the display light. Such, however, are unlike the lens retainer system of the invention in that they each require that the lens is to be squeezed so as to shorten the distance between the lens edges so as to allow it to be positioned between opposing edges of a display light housing lens opening. Further, another U.S. Pat. No. Des. 280,346 of the present inventor, and a patent to Michaud, U.S. Pat. No. Des. 192,124, show fluorescent tube holders that, however, do not include a lens retainer system that is like that described and claimed herein.

Additionally, a number of lighting systems for convenient installation as display lights are shown in U.S. Pat. Nos. to Taussig, et al., 723,943; to Berge, 845,652; to Bixby, 2,336,587; to Husby, et al., 3,064,124; to Aspenwall, the present inventor, 4,535,393; to Brackhahn, et al., 4,598,341; to Federgreen, 4,739,454; and to the present inventor, 4,994,943, none of which involve a lens mounting system that is like that of the invention.

BRIEF SUMMARY OF THE INVENTION

It is a principal object of the present invention in a showcase light lens retainer system to provide a lens retainer for use with a conventional display light that provides for releasably maintaining a lens in covering arrangement over an opening formed in a light housing.

Another object of the present invention in a showcase light lens retainer system is to provide a lens retainer that is easily operated by a person using only their fingers to release and install a lens over an open section of the light housing, providing access to a bulb maintained in the light housing.

Another object of the present invention in a showcase light lens retainer system is to provide a pair plates each pivotally mounted to turn across an end of a flat lens for maintaining that include contact surfaces for engaging sections of adjacent lens sides to maintain the lens in secure covering arrangement over a bulb containing compartment of a conventional display light.

Still another object of the present invention in a showcase light lens retainer system is to provide, with each of the pair of plates, a section thereof for engagement by an operator's finger pivot the plate out of or into covering alignment over and in contact with a lens end.

In accordance with the above objects, a showcase light lens retainer system of the invention is in a pair of rectangular plates each of which is pivotally mounted at its center, to extend an end thereof across a bulb access opening formed in a housing of a conventional showcase or display light. The pair of plates are to maintain ends of a lens formed to fit across the bulb access opening, and are easily pivoted out of engagement with that lens to allow for its removal to open the housing to an operator to remove a burned out bulb or to repair the light, or the like.

Each bar of the pair of plates is formed as a flat rectangular section that is mounted by a center pivot to piers formed in the light housing that are adjacent to opposite ends of the bulb access opening formed into the housing. An end of each plate is contoured such that when pivoted appropriately, will extend into the bulb access opening, with surfaces formed therein for engaging to retain an end of a lens fitted across which opening. To facilitate plate pivoting, opposite tab end sections of each bar are bent downwardly to form right angle sections that are then bent at a right angle thereacross, and are rounded at their end, forming a dog leg section with the right angle section for engaging an end of a lens top edge. The plate is bent at a right angle upwardly forming a wall, and is bent above the wall into side portions that are parallel to the plate and are spaced apart from the plate to slide over a lens edge. Ends of the side portions that are bent down at right angles into a wall with tab sections bent at right angles therefrom to butt against a top edge of the lens. A side portion wall is to engage a lens end edge. The lens corner is thereby maintained by the plate end portion turned thereover with the tab wall, maintaining the lens end over the house opening. Which tabs can have rounded ends for engagement by an operator's finger to provide for plate pivoting.

Other objects and features of the invention will become apparent from the following detailed description in conjunction with the drawings disclosing what is presently contemplated as being the best mode of the invention.

DESCRIPTION OF THE DRAWINGS

In the drawings that illustrate that which is presently regarded as the best mode for carrying out the invention.

DETAILED DESCRIPTION

Figure 1:
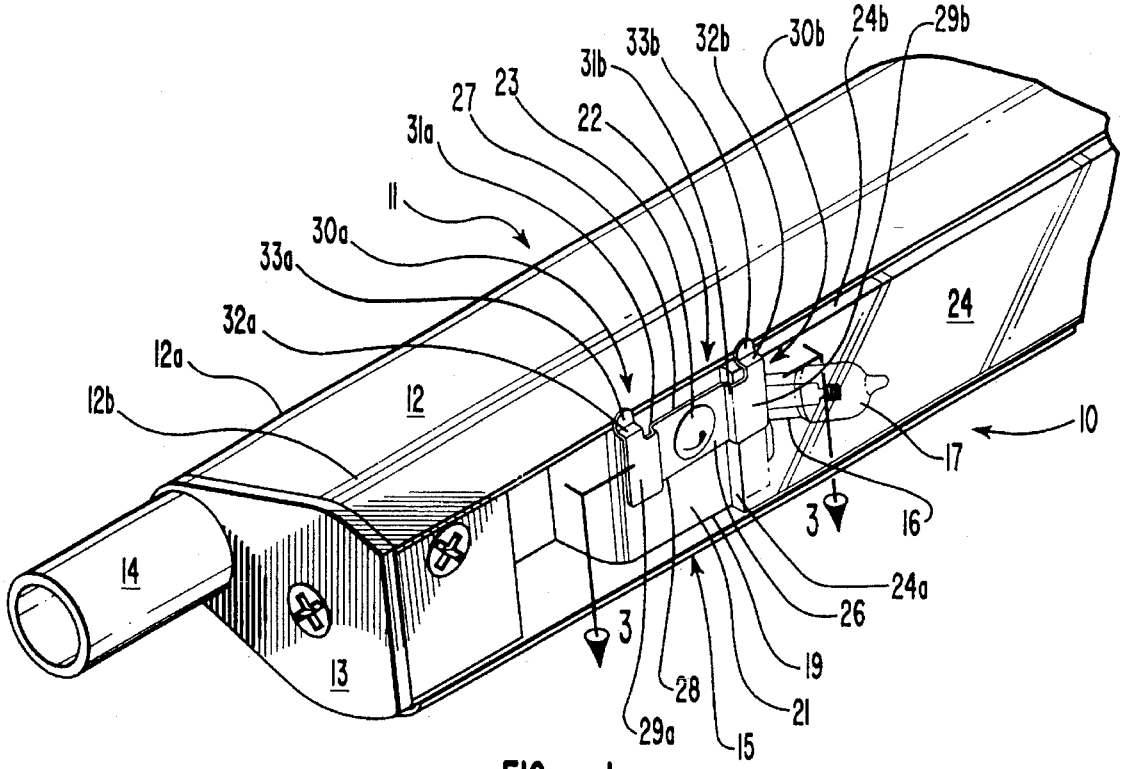
FIG. 1 is a profile perspective view of an end section of a showcase or display light taken from a lens left side and showing one of a pair of showcase light lens retainers of the invention.

FIG. 1 shows a profile perspective view of an end section of a showcase or display case light 10, hereinafter referred to as light. The light 10 shown in FIGS. 1 and 2, as includes a body 11 that is arranged as a shell whose top and bottom surfaces are formed from a single sheet 12 that is bent back upon itself across a midsection, forming a triangular cross section with a flattened curved apex 12*a* with the triangle sides bowed outwardly at 12*b*. End plates 13 are secured across the body 11 ends and cylindrical pivot sections 14 are secured to extend at right angles outwardly from the outer surface of each plate 13, adjacent to the apex 12*a*. Which cylindrical pivot sections 14 are for mounting to brackets, not shown, secured within the showcase or display case to provide for mounting to allow for pivoting of light 10 for pointing an open forward or front face 15 thereof towards an area of the showcase or display case or item or items displayed therein.

As shown, the body 11 is to contain components or elements of the light 10 such as a transformer and wiring and mounts at least one light bulb socket 16 wherein is fitted a light bulb 17 that is accessible through the open forward of front face 15. Which light bulb 17 or bulbs can be a filament, halogen, or like bulb, as is appropriate for providing a desired type and intensity of light for the items as are contained in the showcase or display case. Each socket 16 and bulb 17 are maintained in a compartment 18 in the housing 11 that is formed between a pair of spaced piers 19 that form the ends of compartment 18. One of which piers 19 is shown in FIGS. 1 through 5, with the other pier, it should be understood, being essentially identical thereto. As shown best in FIGS. 4 and 5, the socket is preferably mounted, as by a screw 16*a*, into an inner side 20 of pier 19. Which inner sides 20 of the pair of piers face one another and preferably each mounts a socket 16 for containing a bulb 17. Or, the sockets 16 may be end receptacles for a tube type bulb, not shown, that extends between the receptacles, across the compartment 18, within the scope of this disclosure.

Each pier 19, additional to providing a mount for the socket 16, includes a retainer 22, shown as a thin rectangular plate that is the showcase light lens retainer system of the invention. The retainer 22 is shown in the figures mounted by a pivot 23 to a top surface 21 of pier 19. Shown in FIG. 3, a cylindrical body 23*a* of the pivot 23 is fitted through hole 22*a* formed through the retainer and hole 21*a* formed through the pier top surface 21, the pivot includes a broad head end thereof having an outer edge that extends across the retainer hole 22*a*. The bottom edge of the cylinder 23 is flanged outwardly at 23*b* over the edge of the pier hole 21*a* pivotally coupling the retainer 22 onto the pier top 21. The retainer 22 of the pair of retainers are preferably identical and therefor a description of the one retainer should be taken as a description of the other also, with each retainer arranged to pivot across an end of a lens 24 that is positioned over the open top of compartment 18. Which lens 24 formed as a thin rectangular section of a transparent or transparent material within the scope of this disclosure, as shown best in FIG. 3.

Figure 2:
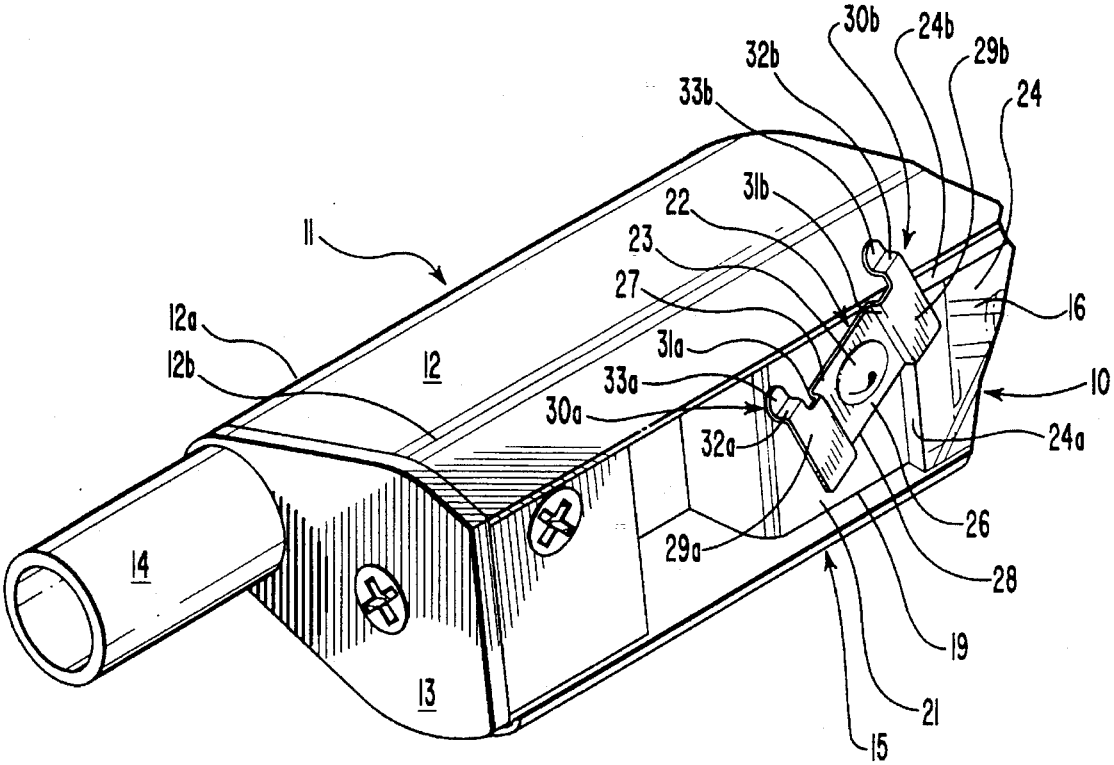
FIG. 2 is an enlarged view of the section of the showcase or display light of FIG. 1 showing the retainer being pivoted.
Figure 3:
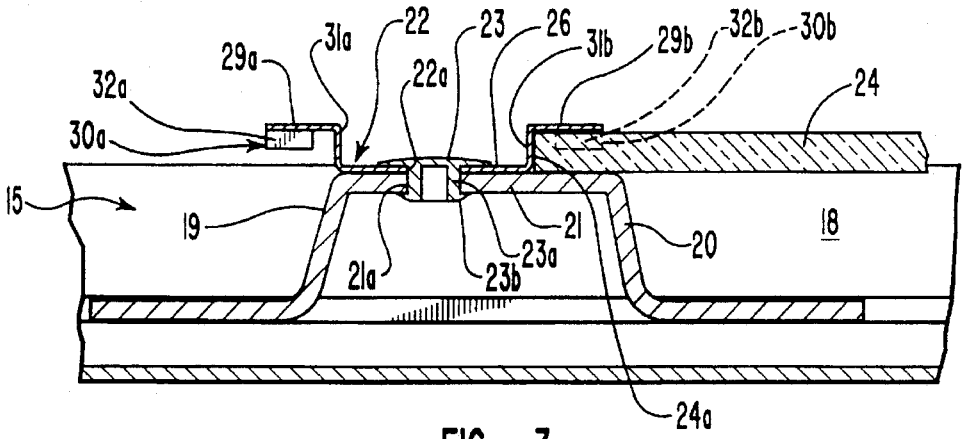
FIG. 3 is an enlarged sectional view taken along the line 3—3 of FIG. 1 showing the retainer maintaining a lens over a bulb opening formed in a showcase or display light body.
Figure 4:
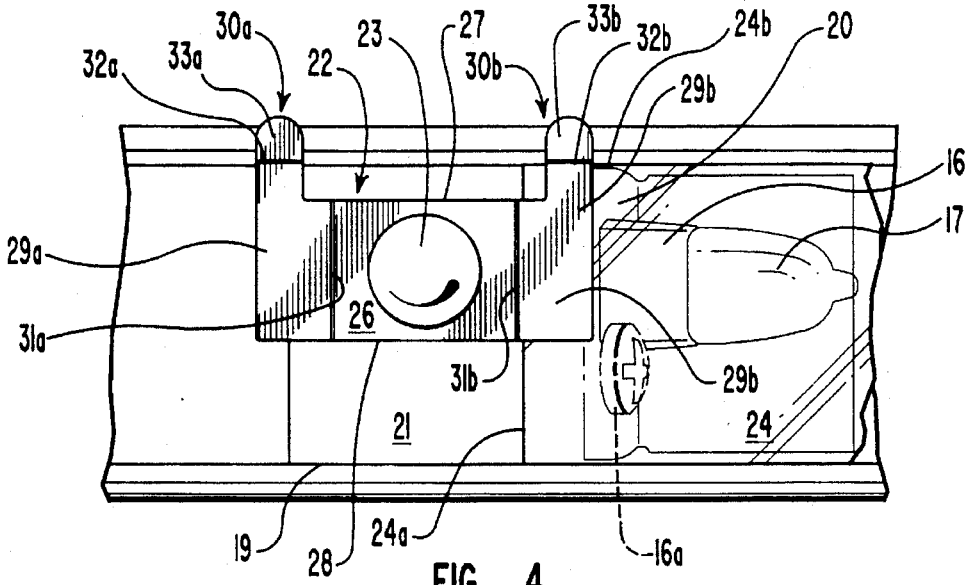
FIG. 4 is an enlarged side elevation view of the section of the showcase or display light with the lens maintained over the bulb opening by the retainer of FIG. 1.
Figure 5:
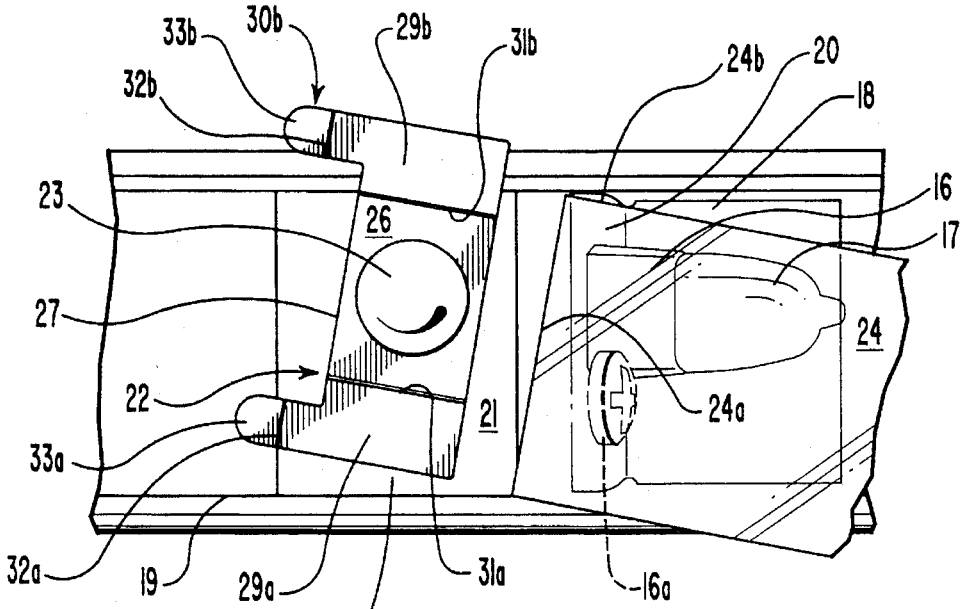
FIG. 5 is a view like that of FIG. 4 only showing the retainer as having been pivoted to move an end thereof out of covering engagement over an end of a lens shown being removed from covering engagement over the housing bulb opening.

The retainers 22 are preferably each formed from a thin flat section of a material, preferably a metal such as spring steel, that is formed to have essentially a rectangular shape and includes a center section 26. Hole 22*a* is formed through the retainer center section, and the retainer includes parallel opposite top and bottom edges 27 and 28, respectively, wherefrom parallel retainer stepped portions 29*a* and 29*b* extend. The stepped end portions 29*a* and 29*b* each include identical tabs 30*a* and 30*b* extending outwardly therefrom and from top edge 27. As shown best in FIG. 3, to provide which stepped portions 29*a* and 29*b* flat right angle walls 31*a* and 31*b* are disposed between parallel edges of the rectangular center section 26 and the opposite edges of parallel portions 29*a* and 29*b*, respectively, providing for stepping the stepped portions upwardly to clear a top surface of the lens 24 end. Accordingly, the height of which right angle walls 31*a* and 31*b* is selected as the thickness of the lens 24 to allow the stepped portions 29*a* and 29*b* to travel thereover, as shown in the figures and best in FIG. 3. Accordingly, each retainer 22 the right angle wall of stepped portion 29*b*, as shown in FIGS. 1, 3 and 4, will fit against for maintaining end 24*a* of lens 24, and are pivoted away from the lens end, as shown in FIGS. 2 and 5. The lens 24 is thereby released for removal to provide access into the chamber 18 as for changing the bulb 17.

Tabs 30*a* and 30*b* extend from the parallel portions 29*a* and 29*b* to provide, at tab walls 32*a* and 32*b*, additional points of retainer 22 contact with the lens 24, at the end of an adjacent lens side 24*b*, with rounded end sections 33*a* and 33*b* provided for engagement by an operator's fingers, not shown, for pivoting the retainer. The tab 30*b* is shown adjacent to the lens end in the figures, with the other tab 30*a* of the pair of retainers 22 adjacent to the other lens end, not shown. Which tabs 30*a* and 30*b* are stepped downwardly from the plane of the stepped portions 29*a* and 29*b* at flat walls 32*a* and 32*b*, respectively, that have a height that is less than the thickness of the lens 24, with wall 32*b* shown in FIGS. 1, 3 and 4 in engagement with the lens side 24*b*. Which wall 32*b* is shown moved out of engagement with lens side 24*b* in FIGS. 2 and 5, as the retainer is pivoted to move the stepped portion 29*b* away from the lens 24 end, releasing the lens.

As shown, rounded end sections 33*a* and 33*b* extend at right angles from a lower edge of the flat walls 32*a* and 32*b* so as to be parallel to the surfaces of stepped portions 29*a* and 29*b* that are to be engaged by an operator, not shown. An operator can, with their fingers, pivot the retainer 22 between the attitudes shown in FIGS. 1, 3 and 4, where the retainer right angle wall 31*b* is in engagement with the lens end 24*a*, and the tab wall 32*b* is in engagement with the lens side 24*b*. Whereafter, the right angle wall 31*b* and tab wall 32*b* can be moved out of lens 24 end engagement, as shown in FIGS. 2 and 5, releasing the lens 24 to allow it to be removed.

As set out above, one retainer 22 of the pair of retainers of the invention is shown and described herein. It should be understood that the mounting and operation of the other retainer is like that described above except, where the retainers are mounted on line to piers 20, each engaging the lens side 24*b*, then the left retainer 22 stepped portion 29*b* will engage the lens 24 end, with the right retainer stepped portion 29*a* engaging the other lens 24 end. Of course, the pair of retainers 22 can be mounted to engage opposite lens corners and so arranged the like stepped sides 29*a* or 29*b* would each engage to maintain a lens 24 end, as described.

Although a preferred form of my invention in a showcase light lens retainer system has been shown and described herein, it should be understood that the present disclosure is made by way of example only and that variations are possible without departing from the subject matter coming within the scope of the following claims and a reasonable equivalency thereof, which subject matter I regard as my invention.

I claim:

1. A showcase light lens retainer system for use with a conventional display light for mounting in a showcase that includes a housing that is open to expose at least one light bulb maintained therein and includes a flat transparent or translucent lens for positioning over the housing opening comprising, a pair of identical retainers, each formed from a thin metal plate to have a flat rectangular shaped center section wherethrough a hole is formed, identical flat rectangular wall segments are each joined along a lower edge of each opposite side of said center section to extend at right angles upwardly therefrom, and said wall segments each connect along an upper edge, at right angles, to an edge of a flat stepped portion that, in turn, includes a flat tab wall that is secured along an upper edge, at a right angle thereto, to extend downwardly from a top edge of said flat stepped portion, and a tab section is connected at a right angle to extend outwardly from a lower edge of said tab wall, which said flat rectangular wall segments each having a height that is at least the thickness of a display light lens, and said tab walls are each of a height that is less than the thickness of said display light lens; a pair or pier means secured to a display light house, arranged on opposite ends of and adjacent to an opening in said display light housing that is to receive said display light lens thereover, and each said pier means includes a hole formed therein; and a pair of pivot means each for fitting through said hole in each said retainer center section and through each said pier means, for providing a pivot coupling of each said retainer to each said pier means.

2. A showcase light retainer system as recited in claim 1, wherein the retainer tab sections are each rounded across their ends opposite to their couplings to the tab walls.

3. A showcase light retainer system as recited in claim 1, wherein each pivot means includes a cylindrical body of a diameter to fit through the retainer center section and pier means holes with a head formed across a top end of said cylindrical body that has a greater diameter than said retainer center section and pier means holes, and, with said cylindrical body fitted through said retainer center section and pier means holes, an edge of a lower end of said cylindrical body is bent outwardly into a flange that has a greater diameter than said retainer center section and pier means holes.

4. A showcase light retainer system as recited in claim 1, wherein the retainers are each fabricated from a thin steel material.

* * * * *